US005494746A

United States Patent [19]

Shiraga et al.

[11] Patent Number: 5,494,746

[45] Date of Patent: Feb. 27, 1996

[54] ACRYLIC FIBER AND PROCESS FOR PRODUCING THE SAME

[75] Inventors: Mitsuaki Shiraga; Hiroyshi Okada, both of Machida; Shigeru Sawayama; Yukino Yamada, both of Yokohama, all of Japan

[73] Assignee: Mitsubishi Kasei Corporation, Tokyo, Japan

[21] Appl. No.: 227,580

[22] Filed: Apr. 14, 1994

Related U.S. Application Data

[63] Continuation of Ser. No. 954,363, Sep. 30, 1992, abandoned.

[30] Foreign Application Priority Data

Oct. 3, 1991 [JP] Japan ..... 3-256795

[51] Int. Cl.[6] ..... D02G 3/00

[52] U.S. Cl. ..... 428/359; 428/373; 428/392; 428/394; 428/357; 428/364

[58] Field of Search ..... 428/364, 357, 428/359, 373, 392, 394

[56] References Cited

U.S. PATENT DOCUMENTS

| | | | |
|---|---|---|---|
| 3,718,717 | 2/1973 | Logemann . | |
| 3,984,601 | 10/1976 | Blickenstaff | 428/400 |
| 4,294,884 | 10/1981 | Bach et al. | 428/364 |
| 4,600,407 | 7/1986 | Huber | 428/364 |
| 4,659,623 | 4/1987 | Yoshinari et al. | 428/364 |
| 4,873,142 | 10/1989 | Bach | 428/364 |
| 4,957,977 | 9/1990 | Itagaki et al. . | |
| 5,064,909 | 11/1991 | Itagaki et al. . | |

FOREIGN PATENT DOCUMENTS

| | | |
|---|---|---|
| 46-25535 | 7/1971 | Japan . |
| 2-238003 | 9/1990 | Japan . |

*Primary Examiner*—Patrick J. Ryan
*Assistant Examiner*—Merrick Dixon
*Attorney, Agent, or Firm*—David G. Conlin; Peter F. Corless

[57] ABSTRACT

An acrylic fiber has 99.9 to 85 mol % of acrylonitrile units, and 0.1 to 15 mol % of N-vinylcarboxylic acid amide units, wherein the latter unit may be modified. The fiber is excellent, e.g., in dyeing property and hygroscopicity, and can be readily converted into a functional fiber.

5 Claims, No Drawings

ACRYLIC FIBER AND PROCESS FOR PRODUCING THE SAME

This is a continuation of application Ser. No. 07/954,363 filed on Sep. 30, 1992, now abandoned.

BACKGROUND OF THE INVENTION

This invention relates to a novel acrylic fiber usable for clothing and to a process for producing the same. The acrylic fiber according to this invention has improved dyeing property and hygroscopic property with regard to use for clothing. The acrylic fiber is also useful as a primary amino group-containing functional fiber and can be used for ion-exchange, chelating, deodorization, disinfection, fixing of enzymes, or the like.

It has been known that fibers produced by spinning copolymers of amide group-containing monomers and acrylonitrile monomers have good hygroscopic property and dyeing property suited for clothing (see, e.g., Japanese Patent Application Laid Open (Kokai) No. 110,920/74). However, such fibers are poor in thermal stability and shrink too much, in particular, in cases where N-substituted acrylamides are contained therein.

It has also been known that primary amino group-containing fibers usable for ion-exchange, chelating, deodorization, disinfection, fixing of enzymes or the like can be produced, e.g., by the aminomethylation of polystyrenes.

It is an object of this invention to provide an acrylic fiber which shrinks less, has improved hygroscopic and dyeing properties and, at the same time, possesses other advantageous properties characteristic of acrylic fibers. It is another object of this invention to provide a primary amino group-containing acrylic fibers useful for ion-exchange, chelating, deodorization, disinfection, fixing of enzymes, or the like.

SUMMARY OF THE INVENTION

As a result of intensive studies, the present inventors have found that the above objects can be attained by a fiber produced by spinning a copolymer of (i) acrylonitrile, and (ii) N-vinylformamide and/or N-vinylacetamide.

Accordingly, this invention is concerned with an acrylic fiber containing from 85 to 99.9 mol % of Structural Unit (I) (acrylonitrile unit) and from 0.1 to 15 mol % of Structural Unit (II) (N-vinylcarboxylic acid amide unit) of the following:

$$-CH_2-\underset{\underset{CN}{|}}{CH}- \quad (I)$$

$$-CH_2-\underset{\underset{NHCOR}{|}}{CH}- \quad (II)$$

(in which R represents a hydrogen atom or a methyl group).

DETAILED DESCRIPTION OF THE INVENTION

The acrylic copolymer to be used in this invention contains from 85 to 99.9 mol % of Structural Unit (I) and from 0.1 to 15 mol % of Structural Unit (II) mentioned hereinabove. In a preferred embodiment, the copolymer contains from 88 to 99.5 mol % of Structural Unit (I) and from 0.5 to 12 mol % of Structural Unit (II).

The viscosity of the copolymers is usually from 10 to 10,000 poise, preferably from 50 to 5,000, more preferably 100 to 3,000 poise, measured in dimethylsulfoxide at 50° C. at a concentration of 15% by weight.

In prior acrylamide derivative-containing fibers, substantial shrinkage usually takes place when the content of acrylamide derivatives amounts to 5 to 10 mol %. However, the fiber according to this invention shrinks less. The fiber exhibits only a slight tendency to shrink in cases where Structural Unit (I) is contained in an amount exceeding 15 mol %. In cases where Structural Unit (II) is contained in an amount exceeding 30 mol %, there is observed a partial fusion of fiber due to high hydrophilicity. When Structural Unit (II) is contained in an amount of 60 mol % or above, it becomes difficult to carry out spinning by coagulating the resultant copolymer solution in water.

The acrylic fiber according to this invention can also be used for ion-exchange, chelating, deodorization, fixing of enzymes, or the like. In this case, the fiber is produced preferably from a cationic copolymer containing Structural Unit (I) and (II), at least 0.1 wt %, preferably 1.0 wt % or more, of Structural Unit (II) being modified.

When Structural Unit (II) is modified, there is usually formed Structural Unit (III) (vinylamine unit) set forth below. There are however cases where a closed ring structure, such as amidine or lactam, is formed through reaction with an adjacent secondary amide or nitrile group, or with an adjacent amide or carboxylic group generated from a nitrile group.

$$-CH_2-\underset{\underset{NH_2}{|}}{CH}- \quad (III)$$

Usually, there is used a copolymer containing from 0.1 to 15 mol %, preferably 1 to 10 mol %, of Structural Unit (III).

Structural Unit (III) can be present in the form of a free amino acid, a salt with a mineral or organic acid, or an ammonium salt.

Structural Unit (III) can be introduced by copolymerizing such monomers as N-vinylphthalimide and N-vinylsuccinimide, followed by partial modification of the copolymerized product under acidic or basic conditions. It can however be preferred, with regard to easiness of copolymerization, to modify part of Structural Unit (II). Detailed explanation will be given hereinbelow on the method of modification.

The copolymer can be produced by copolymerizing 99.9 to 85 mol % of acrylonitrile with 0.1 to 15 mol %, preferably 0.5 to 12 mol %, of N-vinylformamide and/or N-vinylacetamide, followed, if necessary, by modification. The use of N-vinylformamide, rather than N-vinylacetamide, can be preferred with regard to, e.g., copolymerizability with acrylonitrile, properties of fiber prepared therefrom, and easiness of modification. If desired, a mixture of N-vinylformamide and N-vinylformamide can be used.

In the case where the copolymer is modified, starting monomers are copolymerized at a ratio required for the desired final composition.

The copolymer can contain other hydrophilic monomer units, usually in an amount of 0 to 15 mol %, preferably 0 to 5 mol %, more preferably 0 to 2 mol %, provided that the properties of the resulting acrylic fiber are not deteriorated.

As examples of such hydrophilic monomer units, mention may be made of neutral monomer units derived from such monomers as (meth)acrylamides, N-substituted (meth)acrylamides, N,N-dialkyl (meth)acrylamides, N,N-dialkylaminoalkyl (meth)acrylamides, N-alkyl-N-formamide, N-alkyl- N-vinylacetamide, dialkylaminoalkyl (meth)acrylate, allyl alcohol, vinyl alcohol, or the like; basic monomer units derived from such monomers as N-vinylpyrrolidone, vinylpiperidine, vinylimidazole, (meth)acrylamidoalkyl trimethyl ammonium salts, hydroxyalkyl(meth)acryloyloxyalkyl trimethyl ammonium salts, diallyl alkyl ammonium salts, vinylbenzyl trialkyl ammonium salts, or the like; and metal or ammonium salts of acidic monomer units derived from such monomers as (meth)acrylamidoalkylsulfonic acids, (meth)acrylic acid, (meth)acryloyloxyalkanesulfonic acid, (meth)acrylsulfonic acid, vinylsulfonic acid, or the like.

The copolymer can also contain other hydrophobic monomer units, usually in an amount of 0 to 15 mol %, preferably 0 to 5 mol %, provided that the properties of the acrylic fiber are not impaired.

As examples of such monomer units, mention may be made of those derived from acrylates, such as methyl methacrylate, ethyl acrylate, butyl acrylate, octyl acrylate, methoxyethyl acrylate, phenyl acrylate and cyclohexyl acrylate; methacrylates, such as methyl methacrylate, ethyl methacrylate, butyl methacrylate, octyl methacrylate, methoxyethyl methacrylate, phenyl methacrylate and cyclohexyl methacrylate; unsaturated ketones, such as methyl vinyl ketone, ethyl vinyl ketone, phenyl vinyl ketone and methyl isopropenyl ketone; vinyl ethers, such as vinyl acetate, vinyl propionate, vinyl butylate and vinyl benzoate; vinyl ethers; halogenated vinyl or vinylidene compounds, such as vinyl chloride, vinyl bromide and vinylidene chloride; (meth-)acrylonitrile; glycidyl methacrylate; styrene; and the like.

The copolymerization can be carried out in accordance with a known process, including solution polymerization process, suspension polymerization process, precipitation polymerization process, and bulk polymerization process. For the copolymerization, there can be used a known initiator, including azo compounds, such as azobisisobutyronitrile and 2,2'-azobis(2,4-dimethylvaleronitrile); peroxides, such as benzoyl peroxide and potassium persulfate; and redox catalysts. It is also possible to carry out the copolymerization by utilizing heat, light or radiation, without using any initiator. In general, the copolymerization is carried out in an inactive gas atmosphere at a temperature of 30° to 100° C.

The thus obtained secondary amide group-containing copolymer can be modified into a product containing Structural Unit (III), for example, by means of hydrolysis under acidic conditions or under basic conditions.

Specific examples of modification methods applicable to the copolymer include acidic hydrolysis in water; acidic hydrolysis in a hydrophilic solvent, such as water-containing alcohols; non-solvent hydrolysis in an atmosphere of hydrogen chloride gas; alcoholysis under acidic conditions; and the one in which modification is performed while secondary amide groups are being removed as an alkyl ester. In the case of alcoholysis, it can be preferred to use an alcohol having 1 to 4 carbon atoms, although any known alcohols can be used.

In an acidic modification, any strong acid can be used as a modifier, including, e.g., hydrochloric acid, hydrobromic acid, hydrofluoric acid, sulfuric acid, nitric acid, phosphoric acid, sulfamic acid, and alkanesulfonic acids. Such modifiers can be used in an amount of 0.1 to 10 mol., per mol. of secondary amide groups contained in the copolymer. The amount of modifiers is varied in accordance with the desired modification rate. The modification reaction is usually carried out at a temperature of 40° to 120° C.

The modification can be carried out either before or after the spinning of the copolymer. It can however be preferred to subject the copolymer to spinning before it is modified and to effect the modification on and near the surface of the fiber alone.

As mentioned hereinbefore, the main purpose of the modification is to obtain a copolymer containing Structural Unit (III). However, part of Structural Unit (I) or acrylonitirile unit contained in the copolymer may also be decomposed during the modification, resulting in the formation of structural units containing an amide group, a carboxyl group, or the like. There will be no particular problems even if such structural units are contained in the copolymer according to the invention, as long as the composition of the copolymer satisfies the requirements defined hereinabove. In general, however, the copolymer should contain such structural units as less as possible. It is therefore preferred to perform the modification under acidic conditions since nitrile groups generally tend to decompose to a greater extent under basic conditions.

A spinning solution is then prepared by dissolving the thus obtained nitrile copolymer into an appropriate solvent, for example, an organic solvent, such as dimethylsulfoxide and dimethylformamide; an inorganic solvent, such as zinc chloride, rhodanates and nitric acid; or a mixture of these. The quantity of copolymer which can be dissolved into such solvents varies depending on the molecular weight of the copolymer. In usual cases, the copolymer is dissolved in an amount of 5 to 40 wt %, preferably 10 to 30 wt %, based on the total weight of the spinning solution.

A spinning solution can be prepared by dissolving the acrylonitrile copolymer or a modified product thereof obtained as above into a solvent. It can however be preferred to carry out the copolymerization in a solvent which is usable as a solvent for the spinning solution, as well. By using such a solvent, the dissolving step can be omitted. In this case, dimethylsulfoxide, dimethylformamide or the like can be preferred as a solvent.

There is no particular restriction on the method for producing fiber from the spinning solution. In usual case, the spinning solution is subjected to defoaming and filtering, and its temperature is adjusted to 25° to 100° C. Subsequently, the solution is extruded through a spinneret into a solvent (coagulating bath) which is capable of coagulating the copolymer. Any known coagulating bath used for the production of acrylic fibers can be used in this invention, including water and a mixture of water and a solvent, such as those mentioned hereinabove with regard to solvents for the copolymer. As an example of preferable coagulating bath, mention may be made of an aqueous solution of 0° to 80° C. containing a solvent at a concentration of 0 to 80 wt %. The thus obtained coagulated fiber can then be subjected to known aftertreatment, e.g., one or more steps of drawing, drying and densification, to give acrylic fiber.

The invention will be further illustrated by examples. It should however be noted that the scope of the invention will be by no means limited to these examples.

EXAMPLES 1–4 AND COMPARATIVE EXAMPLES 1–2

Into a four-necked 200 ml flask fitted with a stirrer, a nitrogen-introducing tube and a condenser were charged 30 g of mixture of acrylonitrile (hereinafter referred to as "AN") and N-vinylformamide (hereinafter referred to as "NVF") of a ratio as shown in Table 1, 0.5 wt % (based on the weight of the monomers) of 2,2'-azobis(2,4-dimethylvaleronitrile) (initiator), and 120 g of dimethylsulfoxide, and the contents were stirred at room temperature for 30 minutes in an atmosphere of nitrogen. Thereafter, the reaction mixture was stirred for additional 10 hours at 50° C. to obtain a polymer solution.

The polymer solution (or spinning solution) was subjected to defoaming and then extruded at a pressure of 2.0 $Kg/cm^2$ into an aqueous 20 wt % dimethylsulfoxide solution, to obtain fiber. The thus obtained fiber was subjected to aftertreatment (washing, drying, etc.), and then its strength, fineness (g/d), elongation (%), dyeing property and hygroscopicity were tested. Results obtained are shown in Table 1.

(1) Fineness was determined in accordance with JIS-L-1015. Fineness indicates the weight (g) of fiber of a length of 9,000 m. In the method of JIS-L-1015, a bundle of fiber of a length of 30 mm is weighed, and the moisture contained in the fiber is corrected.

(2) Strength and elongation were determined according to JIS-L-1015.

(3) The test of the dyeing property was performed under the conditions of 2 wt % (based on the weight of fiber) by using a cationic dye (Diacryl Red GTL-N, trade name by Mitsubishi Kasei Corp.) and a disperse dye (Dianix/Sarmon Red FB-E, trade name by Mitsubishi Kasei Corp.).

(4) In the test of hygroscopicity, fiber was dried at 100° C. until a constant weight was reached. Subsequently, the fiber was allowed to stand at 24° C. in an atmosphere of 55% RH for 24 hours, and the weight of the fiber was weighed under the same atmosphere. The percentage (based on weight) of increase of its weight was calculated therefrom.

(5) In Table 1 is also shown viscosity of spinning solution measured at 50° C.

As is shown in Table 1, the hygroscopicity and dyeing property of the acrylic fiber obtained tend to be improved with an increase in the content of NVF.

When the content of NVF is 20 mol % or above, the fiber tends to shrink to a slight degree. When it exceeded 30 mol %, there was observed fusion in part of the fiber.

EXAMPLE 5

A fiber was prepared and tested in the same manner as in Examples 1–4, except that AN and N-vinylacetamide were copolymerized in the ratio shown in Table 1. Results obtained are shown in Table 1.

COMPARATIVE EXAMPLE 3

A fiber was prepared and tested in the same manner as in Examples 1–4, except that AN monomers alone were used instead of the mixture of AN/NVF monomers.

The AN fiber containing no NVF was poor in hygroscopicity and dyeing property, as shown in the table. It would therefore be understood that NVF can be effective for the improvement of such properties.

COMPARATIVE EXAMPLE 4

A fiber was prepared and tested in the same manner as in Example 4, except that N,N-dimethylacrylamide was used instead of NVF.

As is shown in Table 1, there was obtained a fiber having improved dyeing property and hygroscopicity as in the case where NVF was used. However, there was resulted an undesirably high shrinkage.

EXAMPLE 6

Into a 100 ml eggplant-type flask fitted with a condenser were charged 0.5 g of fiber obtained in Example 4 and 25 g of aqueous 1.77 mmol hydrochloric acid solution, and the contents were heated at 95° C. for 4 hours to obtain a modified fiber.

By the above treatment, 95% of formamide groups contained in the fiber was modified (the modification rate was estimated on the basis of formic acid formed from formamide groups at the time of hydrolysis).

EXAMPLE 7

Into a 100 ml eggplant-type flask fitted with a condenser were charged 0.5 g of fiber obtained in Example 4, 9.6 g of methanesulfonic acid and 14.9 g of n-butanol, and the contents were heated at 95° C. for 4 hours to obtain a modified fiber. Methanesulfonic acid remained in the modified fiber was thoroughly removed by means of washing with water and immersion into water, and the fiber was vacuum-dried at 50° C. for 15 hours. The strength of the fiber remained almost unchanged.

It was estimated that 5% of formamide groups contained in the fiber was modified (the modification rate was estimated based on the contents of sulfur and carbon atoms resulting from elementary analysis of the modified fiber).

TABLE 1

| | Composition of Copolymer | | Viscosity | Physical Properties of Fiber | | | | | |
|---|---|---|---|---|---|---|---|---|---|
| | Combination of Monomers (*2) | Ratio (ml/ml) | of Spinning Solution (poise) | Fineness (d) | Strength (g/d) | Elongation (%) | Dyeing Property (*1) Disperse Dye | Dyeing Property (*1) Cationic Dye | Hygroscopicity (%) |
| Example 1 | AN/NVF | 99.5/0.5 | 600 | 21 | 1.5 | 46 | B | C | 0.4 |
| Example 2 | " | 98/2 | 620 | 18 | 1.8 | 35 | B | B | 0.5 |
| Example 3 | " | 95/5 | 600 | 16 | 1.8 | 42 | A | B | 0.6 |
| Example 4 | " | 90/10 | 1,900 | 12 | 2.1 | 93 | A | A | 0.8 |
| Example 5 | AN/NVA | 90/10 | 200 | 35 | 1.4 | 39 | C | C | 0.4 |
| Example 6 | AN/NVF | 90/10 | — | 12 | 1.7 | 85 | A | A | 1.1 |
| Example 7 | " | 90/10 | — | 12 | 2.0 | 89 | A | A | 0.9 |
| Comparative Example 1 | AN/NVF | — | 2,700 | 11 | 2.2 | 5 | A | A | 1.3 |
| Comparative Example 2 | " | 70/30 | 440 | Not measurable due to partial fusion of fiber | | | A | A | 2.0 |
| Comparative Example 3 | AN | 100/0 | 320 | 30 | 0.7 | 30 | D | D | 0.2 |

TABLE 1-continued

| | Composition of Copolymer | | Viscosity | Physical Properties of Fiber | | | | | |
|---|---|---|---|---|---|---|---|---|---|
| | Combination | | of Spinning | | | | Dyeing Property (*1) | | Hygro- |
| | of Monomers (*2) | Ratio (ml/ml) | Solution (poise) | Fineness (d) | Strength (g/d) | Elongation (%) | Disperse Dye | Cationic Dye | scopicity (%) |
| Comparative Example 4 | AN/DMA | 90/10 | 290 | 23 | 0.8 | 33 | A | A | 1.3 |

[Notes]
*1. Dying property was rated as follows: A: Excellent, B: Good, C: Dyed with insufficient density, D: Partially dyed with uneven density
*2. AN: acrylonitrile, NVF: N-vinylformamide, NVA: N-vinylacetamide, DMA: N,N'-dimethylacrylamide In accordance with this invention, there can be produced an acrylic fiber having improved dyeing property and hygroscopicity, as well as a modified acrylic fiber containing primary amino groups introduced through modification of secondary amide groups. Accordingly, the invention will greatly contribute to the field of functional fibers to be used for ion exchange, chelating, deodorization, fixing of enzyme, or the like.

We claim:

1. An acrylic fiber comprising from 99.9 to 85 mol % of Structural Unit (I) and from 0.1 to 15 mol % of Structural Unit (II) of the following:

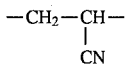

(I)

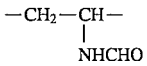

(II)

(in which R represents a hydrogen atom or a methyl group).

2. An acrylic fiber as claimed in claim 1, wherein Structural Unit (I) is contained at a percentage of 88 to 99.5 mol %, and Structural Unit (II) is contained at a percentage of 0.5 to 12 mol %.

3. An acrylic fiber consisting essentially of 99.9 to 85 mol % of Structural Unit (I) and of 0.1 to 15 mol % of Structural Unit (II) wherein Structural Unit (I) and Structural Unit (II) have the following formula:

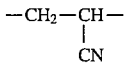

(I)

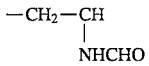

(II)

4. An acrylic fiber as claimed in claim 3, wherein Structural Unit (I) is contained at a percentage of 88 to 99.5 mol % and Structural Unit (II) is contained at a percentage of 0.5 to 12 mol %.

5. The acrylic fiber of claim 3 that constitutes of 99.9 to 85 mol % of Structural Unit (I) and of 0.1 to 15 mol %. of Structural Unit (II).

* * * * *